United States Patent [19]

Ono et al.

[11] Patent Number: 4,734,353

[45] Date of Patent: Mar. 29, 1988

[54] METHODS USING OXIMES FOR PROCESSING A SILVER HALIDE PHOTOGRAPHIC LIGHT-SENSITIVE MATERIAL

[75] Inventors: Mitsunori Ono; Isamu Itoh; Keiji Mihayashi, all of Kanagawa, Japan

[73] Assignee: Fuji Photo Film Co., Ltd., Kanagawa, Japan

[21] Appl. No.: 857,505

[22] Filed: Apr. 21, 1986

Related U.S. Application Data

[63] Continuation of Ser. No. 637,648, Aug. 3, 1984, abandoned.

[30] Foreign Application Priority Data

Aug. 8, 1983 [JP] Japan ..... 58-145338

[51] Int. Cl.[4] ..... G03C 5/54; G03C 5/26

[52] U.S. Cl. ..... 430/236; 430/212; 430/218; 430/223; 430/219; 430/239; 430/487; 430/543; 430/559; 430/564; 430/607; 430/611; 430/613; 430/955; 430/957; 430/959

[58] Field of Search ..... 430/212, 218, 219, 221, 430/223, 236, 239, 251, 487, 955, 957, 959, 543, 559, 564, 566, 607, 611, 613

[56] References Cited

U.S. PATENT DOCUMENTS

| | | | |
|---|---|---|---|
| 4,202,694 | 5/1980 | Taylor | 430/218 |
| 4,269,925 | 5/1981 | Barton et al. | 430/221 |
| 4,298,674 | 11/1981 | Land et al. | 430/220 |
| 4,355,092 | 10/1982 | Mehta et al. | 430/219 |
| 4,355,101 | 10/1982 | Mehta et al. | 430/219 |
| 4,358,525 | 11/1982 | Mooberry et al. | 430/219 |
| 4,420,554 | 12/1983 | Ohashi et al. | 430/219 |
| 4,481,286 | 11/1984 | King et al. | 430/218 |

*Primary Examiner*—Richard L. Schilling

*Attorney, Agent, or Firm*—Sughrue, Mion, Zinn, Macpeak, and Seas

[57] ABSTRACT

A method for processing a silver halide photographic light-sensitive material comprising a support having thereon a light-sensitive silver halide emulsion layer having associated therewith a blocked photographic agent capable of releasing a photographically useful agent, which method comprises processing the photographic light-sensitive material in the presence of an oxime.

According to this method for processing a silver halide photographic light-sensitive material, both stability of the photographic light-sensitive material during storage and release of a photographically useful agent during processing are achieved without undersirable side-reactions, and a high sensitivity/fog ratio is obtained.

17 Claims, No Drawings

METHODS USING OXIMES FOR PROCESSING A SILVER HALIDE PHOTOGRAPHIC LIGHT-SENSITIVE MATERIAL

This is a continuation of application Ser. No. 637,648, filed Aug. 3, 1984, now abandoned.

FIELD OF THE INVENTION

The present invention relates to a method for processing a silver halide photographic light-sensitive material and more particularly, to a method for processing a photographic light-sensitive material comprising a light-sensitive silver halide emulsion layer having associated therewith a blocked photographic agent capable of releasing a photographically useful agent.

BACKGROUND OF THE INVENTION

Many photographically useful agents may be advantageously incorporated in a photographic light-sensitive material to aid, for example, in processing, and they typically differ from those which are used as additives in a processing solution. Their incorporation in a photographic light-sensitive material enables effective utilization of photographic agents which tend to decompose under acidic, alkaline or oxidation-reduction conditions, and consequently, cannot withstand prolonged storage in a processing bath. At the same time, it is possible to simplify the composition of the processing solution used and to facilitate the preparation of the processing solution. In addition, it is possible to provide required photographic agent which functions only at a desired time during the photographic processing or only in a specified layer and the neighboring layers of a multilayer photographic light-sensitive material. Furthermore, the amount of photographic agent released from the precursor in the photographic light-sensitive material can be varied depending on the extent of silver halide development. However, if a photographic agent is added to a photographic light-sensitive material in its active form, the photographic agent does not exhibit the expected degree of activity because during storage before photographic processing, it reacts with other components contained in the photographic light-sensitive material or it is decomposed by heat, oxygen and so on.

One method for solving this problem involves adding a photographic agent to a photographic light-sensitive material in the form of its precursor i.e., in a form such that its active group is blocked and rendered photographically inactive. This method has various advantages in different applications. For instance, when the useful photographic agent is a dye, blocking a functional group of the dye which has a significant effect on its spectral absorption characteristic results in a shift of its spectral absorption band to shorter wavelengths or to longer wavelengths. Therefore, even if the dye is present in a silver halide emulsion layer having a spectral sensitivity in the wavelength region corresponding to the absorption band of the dye in the unblocked state, a lowering of the sensitivity due to the "filter effect" can be prevented.

Where the useful photographic agents are antifoggants or development restrainers, blocking of their active groups makes it possible to suppress desensitization arising from adsorption of these agents to light-sensitive silver halide grains and formation of silver salts during storage. At the same time, release of these agents when required permits the reduction of fog density without an accompanying decrease in sensitivity, along with the prevention of fog due to overdevelopment, stopping development at a desired time, and so on.

In still another case where the useful photographic agents are developing agents, auxiliary developing agents or fogging agents, if their active or adsorptive groups are blocked, various photographically adverse effects which arise from semiquinones and oxidants produced by air oxidation upon storage can be prevented. Generation of fogging nuclei upon storage can also be prevented because injection of electrons into the silver halide grains can be inhibited, resulting in stable processing.

Where the useful photographic agent is a bleach accelerating agent or a bleach-fix accelerating agent, it is possible to prevent reactions with other components also present in the photographic light-sensitive material during storage by blocking its active group, and to fully activate the agent at a desired time by removing the blocking group during processing.

In the present invention the above-described "active group", "functional group" and "adsorptive group" are generally referred to as the "active group".

As described above, photographic agent precursors can be extremely valuable in playing photographic agents to their best advantage. However, such precursors must satisfy two very severe requirements in practical use, that are contradictory to each other; one is ensuring stability the precursor during a storage condition, and the other is removing its blocking group at a desired time during processing and thereby releasing the photographic agent rapidly and efficiently.

A number of techniques for blocking a photographic agent are known. For instance, a technique using a blocking group such as an acyl group, a sulfonyl group or the like is described in Japanese Patent Publication No. 48805/72 (corresponding to U.S. Pat. No. 3,615,617); one which utilizes such blocking groups to release a photographic agent by the so-called reversal Michael reaction is described in Japanese Patent Publication Nos. 39727/79, 9696/80 and 34927/80 (corresponding to U.S. Pat. Nos. 3,674,478, 3,791,830 and 4,009,029, respectively); one which utilizes such a blocking group to release a photographic agent with the production of quinone methide or its analogs by intramolecular electron transfer is desired in Japanese Patent Publication No. 39727/79 (corresponding to U.S. Pat. No. 3,674,478), Japanese Patent Application (OPI) Nos. 135944/82 (corresponding to U.S. Pat. No. 4,416,977), 135945/82 (corresponding to U.S. Pat. No. 4,420,554) and 136640/82 (corresponding to U.S. Pat. No. 4,420,554) (the term "OPI" as used herein refers to a "published unexamined Japanese patent application"); one which utilizes an intramolecular ring-closing reaction is described in Japanese Patent Application (OPI) No. 53330/80 (corresponding to U.S. Pat. No. 4,310,612); one which utilizes cleavage of a 5-membered or 6-membered ring is described in Japanese Patent Application (OPI) Nos. 76541/82 (corresponding to U.S. Pat. No. 4,335,200), 135949/82 (corresponding to U.S. Pat. No. 4,350,752) and 179842/82: and so on. However, these photographic agents blocked with known blocking groups have several disadvantages. For example, although stable during storage, some precursors require a highly alkaline condition, such as a pH higher than 12, for processing because the photographic agent-releasing rate thereof is too slow. On the other hand, some precursors decompose gradually, losing their function as precursors during storage, even though they can release the photographic agent at a sufficiently fast rate when processed under mild conditions, such as a pH range of 9 to 12.

These defects are considered to be a result of the fact that release of photographically useful agents from the blocked photographic agents relies upon the attack of $OH^-$ ions. The ratio of $OH^-$ ion concentration between storage at a pH of from 6 to 7 and processing at a pH of from 9 to 12 at which conventional photographic light-sensitive materials are developed is from $10^2$ to $10^6$. Thus it is assumed that, for example, blocked photographic agents capable of releasing photographically useful agents at a half-life period of 3 minutes (i.e., 3 minutes is required for the decomposition of one-half the amount added) when processed at a pH of 10, will undergo decomposition at a half-life period of about 500 hours (3 min$\times 10^4$) if stored at pH 6. This means that one half of the precursor added decomposes after about a 3-week storage period. Such blocked photographic agents are of no practical use at all. Further, blocked compounds which release photographically useful agents at a half-life period of 3 minutes when processed at a pH of 11, will have a half-life period during storage of about 30 weeks (10 times the above half-life period). This value is still unsatisfactory, and such precursors can be said to be unsuitable for practical use from the viewpoint of storage stability.

Another problem ascribable to the fact that the release of photographically useful agents from blocked photographic agents relies upon the attack of $OH^-$ ions is a reduction in the efficiency of releasing the photographically useful agents. That is, simultaneously with the release of the photographically useful agents, the action of $OH^-$ ions causes unexpected side-reactions, destroying the blocked photographic agents prior to the release of the photographically useful agents. This is reported in, for example, U.S. Pat. No. 4,135,929, *Yuki Gosei Kyokai Shi* (Journal of Synthetic Organic Chemistry, Japan), Vol. 39, page 331 (1981) and ibid, Vol. 40, page 176 (1982). This reduction in the releasing efficiency leads to an increase in the amount of blocked photographic agents required. Furthermore, in some cases, by-products resulting from the unexpected side-reactions adversely affect the photographic characteristics, making it unsuitable to use such blocked photographic agents for the expected purposes.

On the other hand, photographic usefulness of antifoggant precursors is known based on the observation that the sensitivity/fog ratio is greatly increased by a method in which antifoggants function on the way of the development step in conventional color development processing in comparison with a method in which the antifoggants function from the beginning of the development step. The term "on the way of the development step" means a step in which a development at exposure area attains to a late stage (i.e., an amount of the developed silver is increased) but fog is at an induction period yet (i.e., no fog is generated yet). The terms "Induction period" and "late stage" mean so-called an allover induction period and a late stage, respectively, which are limited in C. E. K. Mees and T. H. James, *The Theory of Photographic Process,* 3rd ed., pp. 352–353 (1966). Furthermore, it is disclosed in U.S. patent application Ser. No. 564,659 that precursor compounds of pyrazolidone type contribute to acceleration of development and an increase in sensitivity.

SUMMARY OF THE INVENTION

An object of the present invention is a general method which can be broadly utilized, providing both good stability of precursors during storage and efficient release of photographically useful agents at a desired time during processing.

Another object of the present invention is to provide a method capable of efficient release of photographic agents even by processing at a relatively low pH of 9 to 12.

A further object of the present invention is to provide a general method of increasing the release efficiency of photographically useful agents while retarding side-reactions.

A further object of the present invention is to provide a method for development processing that increases the sensitivity/fog ratio.

A further object of the present invention is to provide a method for development processing of color photographic light-sensitive materials, in which the sensitivity/fog ratio is greatly increased.

Other objects of the present invention will become apparent from the following detailed description and examples.

It has been found that these objects are attained by a method of processing a silver halide photographic light-sensitive material, comprising a support having thereon a light-sensitive silver halide emulsion layer having associated therewith a blocked photographic agent capable of releasing a photographically useful agent, in the presence of an oxime.

DETAILED DESCRIPTION OF THE INVENTION

Preferred examples of the oxime which can be used in the present invention are represented by the following general formula (I):

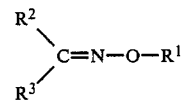

(I)

wherein $R^1$ represents a hydrogen atom, a group capable of cleaving in contact with an alkali component or other component contained in a processing solution, or a group capable of forming a counter ion together with an oxygen anion in contact with a processing solution, and includes all groups capable of cleaving to form an oxime structure at the time of processing, and $R^1$ may form a ring together with $R^2$ or $R^3$ which forms an oxime upon cleavage; and $R^2$ and $R^3$, wich may be the same or different, each represents preferably a hydrogen atom, an alkyl group, an alkenyl group, an aryl group, an aralkyl group, an acyl group, a carboxy group, an oxycarbonyl group, a carbamoyl group, an imino group, an amino group, a carbonamido group, a sulfonamido group, a ureido group or a heterocyclic group, each of which may be further substituted, and $R^2$ and $R^3$ may form a ring, preferably a 5-membered, 6-membered or 7-membered saturated or unsaturated ring, a 5-membered, 6-membered or 7-membered unsaturated ring to which a benzene ring is fused or a 5-membered, 6-membered or 7-membered heterocyclic ring containing a hetero atom, each of which rings may be further sbstituted.

$R^2$ and $R^3$ may be substituted with a halogen atom, a hydroxy group, an alkoxy group, an alkyl group, an aryl group, a nitro group, a carboxy group, a carbonamido group, a sulfonamido group or a methylol group.

In more preferred compounds represented by general formula (I), $R^1$ represents a hydrogen atom or an acyl group; $R^2$ represents a hydrogen atom, a substituted or unsubstituted alkyl group or a substituted or unsubstituted aryl group; $R^3$ represents a substituted or unsubstituted alkyl group, a substituted or unsubstituted aryl group, a substituted or unsubstituted acyl group, a substituted or unsubstituted alkoxycarbonyl group, a carboxy group, a hydroxylimino group or a heterocyclic group; and $R^2$ and $R^3$ may form a ring including cyclopentane, cyclohexane, cyclohexadiene, cycloheptane, cycloheptadiene, indane or fluorene, which rings may be further substituted.

In the most preferred compounds represented by general formula (I), $R^1$ represents a hydrogen atom; $R^2$ represents a hydrogen atom, a substituted or unsubstituted methyl group or a substituted or unsubstituted ethyl group; and $R^3$ represents a phenyl group which has at least one hydroxy group at the ortho positions thereof and may be further substituted, a substituted or unsubstituted hydroxylimino group, a pyridyl group which may be substituted or a purinyl group which may be substituted; and $R^2$ and $R^3$ may form cyclopentane which may be substituted, or cyclohexane which may be substituted.

In the method according to the invention, the compounds represented by general formula (I) may be added to a processing solution or incorporated into a photographic light-sensitive material. When the compounds are added to the processing solution, those having from 1 to 10 carbon atoms are especially preferred from the viewpoint of solubility. When, on the other hand, they are incorporated into the photographic light-sensitive material, the number of carbon atoms of the compounds is not critical. When a photographically useful agent is to be released only in a specific layer of the multilayer photographic light-sensitive material, compounds of the so-called ballast type are preferably used.

The term "blocked photographic agent capable of releasing a photographically useful agent" as used herein includes all the blocked photographic agents capable of releasing a photographically useful agent upon hydrolysis with alkalis (i.e., photographically useful agent precursors). These include redox compounds which release a photographically useful agent upon hydrolysis after the oxidation-reduction reaction at the time of develoment, such as DIR compounds (development inhibitor releasing compounds) described in U.S. Pat. No. 3,379,528, *Journal of Organic Chemistry,* Vol. 29, page 588 (1964), and Japanese Patent Application (OPI) Nos. 129536/74 and 13369,77, and DRR compounds (dye-releasing redox compounds) described in U.S. Pat. Nos. 3,928,312, 4,076,529 and 4,135,929, and Japanese Patent Application (OPI) No. 113624/76.

Preferred examples of the blocked photographic agents capable of releasing a photographically useful agent are those precursor compounds which release a photographically useful agent by the nucleophilic attack of $OH^-$ ion in a processing solution and the subsequent reaction. Examples of such precursor compounds include those of the following classes (II) to (IV):

(II) Precursor compounds containing therein at least one of a

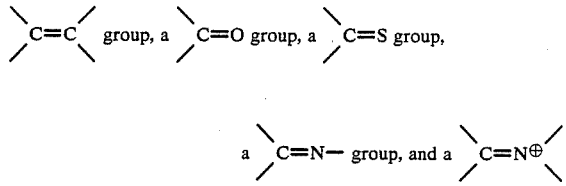

group and releasing a photographically useful agent (hereinafter represented by a symbol "A") by a reaction involving the attack of $OH^-$ ion on the carbon atom of the functional group and the subsequent reaction.

Subsequent to the attack of $OH^-$ ion on the carbon atom of the functional group, A is released by: (1) cleavage of a bond between the carbon atom and A; (2) cleavage of another bond involving electron transfer; (3) cleavage of another bond by intramolecular nucleophilic attack with or without electron transfer; (4) a combination of two or more reaction modes as described above; and (5) release through a timing group.

(III) Precursor compounds containing therein at least one of a

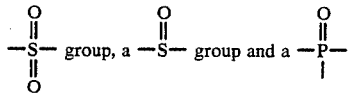

group and releasing A by the attack of $OH^-$ ion on the sulfur or phosphorus atom of the functional group and the subsequent reaction.

The mechanism of release of A in these precursor compounds is the same as described for (II) above, with the exception that the reaction involving direct electron transfer to the sulfur or phosphorus atom is not included. (IV) Precursor compounds which release A through a reaction involving bond-cleavage occurring to nucleophilic attach of $OH^-$ ion on the carbon of a

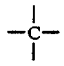

group.

The mechanism of release of A in these precursor compounds is, after the first bond-cleavage, the same as described for (II) or (III) above.

Precursor compounds belonging to (II) above include sulfur release type antifoggant or development inhibitor precursors as described in Japanese Patent Publication No. 9968/73, Japanese Patent Application (OPI) Nos. 8828/77, 82834/82, and U.S. Pat. Nos. 3,311,474 and 3,615,617; carbamoyl-substituted benzotriazole precursors as described in British Pat. No. 2,035,589; precursors releasing A by the cleavage of an acetyl group and the subsequent electron transfer, or additionally decarboxylation as described in Japanese Patent Publication No. 39727/79, U.S. Pat. Nos. 3,674,478, 3,932,480 and 3,993,661, and Japanese Patent Application (OPI) No. 1140/83; precursors releasing a developing agent or a development accelerator as described in U.S. Pat. No. 4,330,617 and Japanese Patent Application (OPI) No. 40245/82; precursors releasing A by ring-cleavage and a subsequent intramolecular ring-closing reaction as described in Japanese Patent Publication No. 22099/82, U.S. Pat. No. 4,199,354, and Japanese Patent Application (OPI) No. 53330/80; ED compound precursors involving ring-cleavage as described in Japanese Patent Application (OPI) Nos. 110827/78 and 138736/81; precursors releasing A by hydrolysis and a subsequent intramolecular ring-closing reaction as described in Japanese Patent Application (OPI) No. 53330/80; precursors releasing A by ring-cleavage and a subsequent electron transfer, and decarboxylation as described in Japanese Patent Application (OPI) Nos. 76541/82, 135949/82, and 179842/82; precursors releasing A by the nucleophilic attack of $OH^-$ ion on a carbon-carbon double bond and the subsequent elimination as described in *Research Disclosure,* 15162 (1976), Japanese Patent Application (OPI) No. 77842/81, and U.S. Pat. No. 4,307,175; p-phenylenediamine precursors as described in U.S. Pat. Nos. 3,342,597 and 3,342,599; and dye precursors as described in U.S. Pat. Nos. 3,336,287, 3,579,334, 3,999,991, Japanese Patent Application (OPI) Nos. 26541/75 and 53330/80.

Precursors releasing A by the nucleophilic attack of $OH^-$ ion after the redox reaction include development inhibitor releasing hydroquinone or sulfonamidonaphthol compounds as described in U.S. Pat. No. 3,379,529 and Japanese Patent Application (OPI) No. 13369/77, and DRR compounds (Dye Releasing Redox compounds) as described in U.S. Pat. Nos. 3,928,312 4,076,529 and 4,135,929, and Japanese Patent Application (OPI) No. 113624/76.

Precursor compounds belonging to (III) above include sulfonyl group containing precursor compounds as described in Japanese Patent Application (OPI) No. 8828/77.

Precursor compounds belonging to (IV) above include compounds releasing a dye by the attack of $OH^-$ ion on the quinonemethyl group as described in U.S. Pat. No. 3,728,113 and compounds releasing a dye as a consequence of cleavage of the thiazolidine ring as described in Japanese Patent Application (OPI) No. 12022/73.

More preferred blocked photographic agents capable of releasing a photographically useful agent which can be used in the present invention are the precursor compounds belonging to (II) above. In particular, precursor compounds containing therein at least one of a

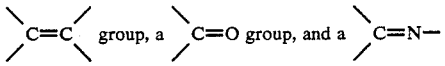

group and capable of releasing a photographically useful agent by reactions involving the attack of $OH^-$ ion on the carbon atom of these functional groups and the subsequent reaction are preferred.

Photographically useful agents released from the precursor compounds include antifoggants, development inhibitors, developing agents, development accelerators, electron donors (E.D.), foggants, nucleating agents, silver halide solvents, bleach accelerators, bleach-fix accelerators, fix accelerators, dyes, coloring materials for color diffusion transfer, and couplers. Typical examples of the antifoggants and development inhibitors include mercaptotetrazoles, mercaptothiadiazoles, benzotriazoles, and indazoles. Specific examples of the developing agents and development accelerators include hydroquinones, catechols, aminophenols, p-phenylenediamines, pyrazolidones, and ascorbic acids. The electron donors, foggants and nucleating agents include α-hydroxyketones, α-sulfonamidoketones, hydrazines, hydrazides, tetrazolium salts, aldehydes, acetylenes, quaternary salts, and ylide compounds. The silver halide solvents include thioethers, rhodanines, sodium thiosulfate, and methylenebissulfones. The bleach accelerators and bleach-fix accelerators include aminoethanethiols, sulfoethanethiols, and aminoethanethiocarbamates. The fix accelerators include sodium thiosulfate. The dyes include azo dyes, azomethine dyes, anthraquinone dyes, and indophenol dyes. The coloring materials for color diffusion transfer include azo dyes containing a redox moiety and chelate azo and chelate azo methine dyes containing a redox moiety. The couplers include yellow color forming couplers having an α-acylacetanlide moiety, magenta color forming couplers having a pyrazolone moiety, magenta color forming couplers having a pyrazolotriazole moiety, cyan color forming couplers having a phenol moiety, cyan color forming couplers having a naphthol moiety, and DIR couplers (Development Inhibitor Releasing couplers).

The photograhically useful agent used in the present invention is not unduly limited, and may be freely selected from those known in the art depending on the photographic characteristics desired. An object of the present invention is to provide a release-acceleration means which overcomes the deficiencies encountered in conventional techniques in which the release of the photographically useful agent from precursors relies upon the attack of $OH^-$ ion. For any of the known precursor compounds included in classes (II) to (IV), the above object is attained irrespective of the particular type of photographically useful agent which is released.

It is surprising that the compounds represented by general formula (I) markedly accelerate the release of various photographically useful agents from the precursor compounds of the groups (II) to (IV), and greatly increase the release efficiency, and the exact reason why these highly desirable effects are obtained is not completely understood. However, the reasons for the unexpectedly increased rate of release of the photographically useful agent from its precursor compound, when the precursor compound being used together with the compounds represented by general formula (I), as compared with the case where the agent is released by the nucleophilic reaction of $OH^-$ ion and the subsequent reaction, are considered to be that: (1) the compounds represented by general formula (I) greatly increase the nucleophilicity of $OH^-$ ion; (2) the compounds represented by general formula (I) also contribute to the nucleophilic attack in place of $OH^-$ ion and their nucleophilicity is much higher than that of $OH^-$ ion; or (3) a combination of the above effects. Whatever its precise mechanism, it is clear that the present invention provides a means of overcoming the contradictory requirements, of storage stability and efficient deblocking during processing, particularly in the processing of conventional photographic light-sensitive materials at relatively low pH values (9 to 12).

The term "conventional photographic light-sensitive material" as used herein means a photographic light-sensitive material in which an image is formed by reducing silver halide grains having development centers (latent images or fogged nuclei) prior to the development, with developing agents having a structure satisfying the Pelz rule, and excludes the material used in the diffusion transfer process.

The amount of the blocked photographic agent capable of releasing a photographically useful agent to be added according to the present invention varies with the type of the photographically useful agent released. Typical examples are shown below:

Mercapto type antifoggants: from about $10^{-9}$ to $10^{-1}$ mol, preferably from about $10^{-6}$ to $10^{-2}$ mol, per mol of silver;

Azole type antifoggants represented by benzotriazoles: from about $10^{-8}$ to $10^{-1}$ mol, preferably from about $10^{-5}$ to $10^{-2}$ mol, per mol of silver;

Auxiliary developing agents such as pyrazolidones: from about $10^{-4}$ to 10 mols, preferably from about $10^{-2}$ to 5 mols, per mol of silver;

Developing agents such as hydroquinones, aminophenols and p-phenylenediamines; from about $10^{-4}$ to 10 mols, preferably from about $10^{-2}$ to 5 mols, per mol of silver;

Foggants or nucleating agents represented by hydrazines, hydrazides, quaternary salts, or acetylenes: from about $10^{-9}$ to $10^{-1}$ mol, preferably from about $10^{-6}$ to $10^{-2}$ mol, per mol of silver;

Silver halide solvents such as thioethers, sodium thiosulfate, or rhodanines: from about $10^{-3}$ to 10 mols, preferably from about $10^{-2}$ to 5 mols, per mol of silver;

Azo dyes or coloring materials for color diffusion transfer light-sensitive materials: from about $10^{-4}$ to 10 mols, preferably from about $10^{-2}$ to 1 mol, per mol of silver.

When the compound of the general formula (I) is added to the processing solution, the amount of the compound added is from about $10^{-3}$ to 1 mol/l, preferably from about $10^{-2}$ to $5\times10^{-1}$ mol/l. When it is added to the photographic light-sensitive material, the amount of the compound added is from about $10^{-7}$ to 10 mol, preferably from about $10^{-5}$ to 1 mol, per mol of silver.

Specific examples of the oximes which can be effectively used in the present invention are illustrated below, but the present invention is not to be construed as being limited thereto.

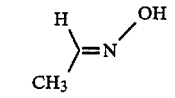
(I)-(1)

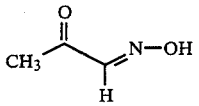
(I)-(2)

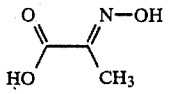
(I)-(3)

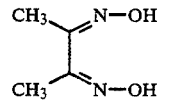
(I)-(4)

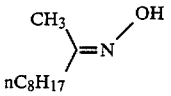
(I)-(5)

-continued

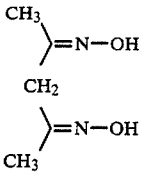
(I)-(6)

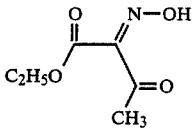
(I)-(7)

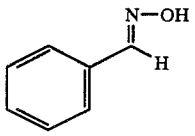
(I)-(8)

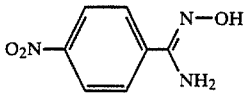
(I)-(9)

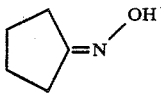
(I)-(10)

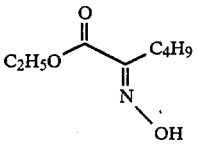
(I)-(11)

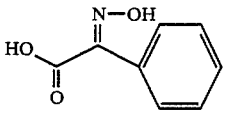
(I)-(12)

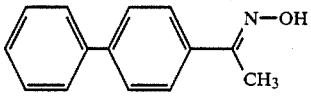
(I)-(13)

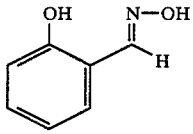
(I)-(14)

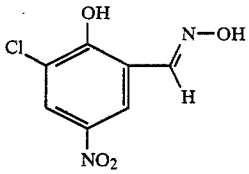
(I)-(15)

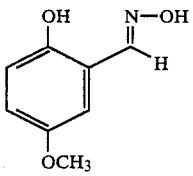
(I)-(16)

-continued
(I)-(17)
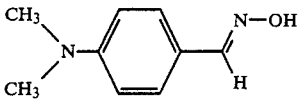
(I)-(18)
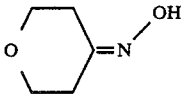
(I)-(19)
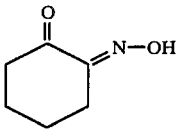
(I)-(20)
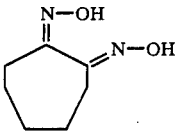
(I)-(21)
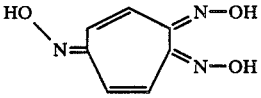
(I)-(22)
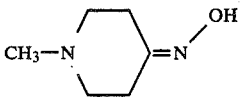
(I)-(23)
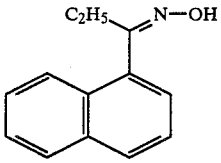
(I)-(24)
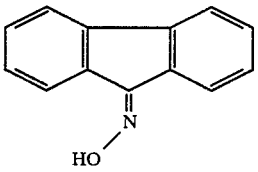
(I)-(25)
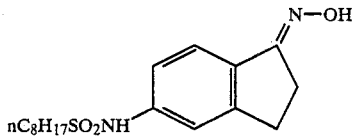
(I)-(26)
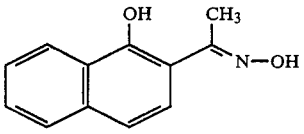
-continued
(I)-(27)
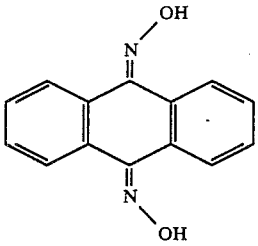
(I)-(28)
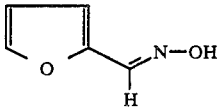
(I)-(29)
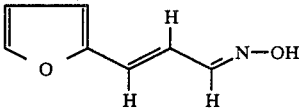
(I)-(30)
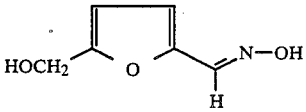
(I)-(31)
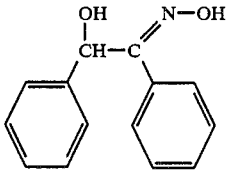
(I)-(32)
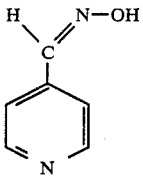
(I)-(33)
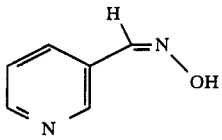
(I)-(34)
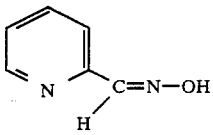
(I)-(35)
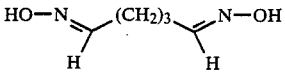
(I)-(36)
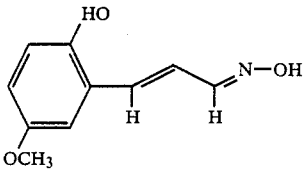

-continued
(I)-(37)
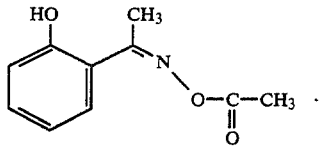
(I)-(38)
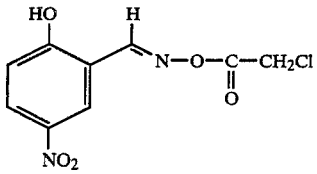
(I)-(39)
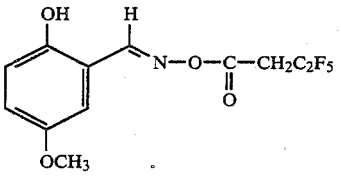
(I)-(40)
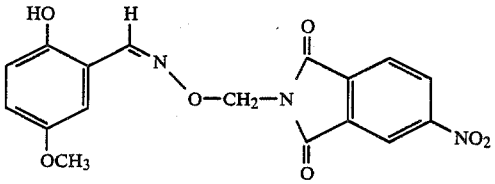
(I)-(41)
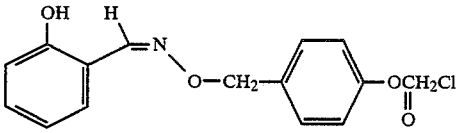
(I)-(42)
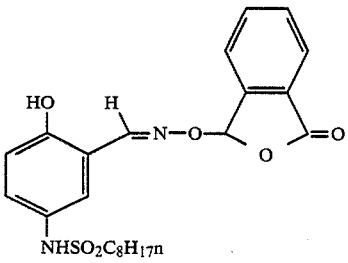
(I)-(43)
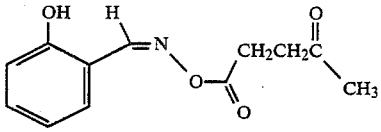
(I)-(44)
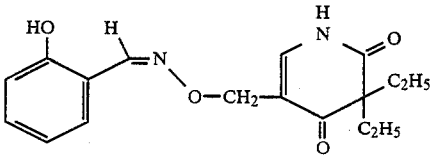
-continued
(I)-(45)
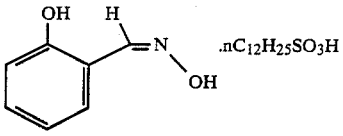
(I)-(46)
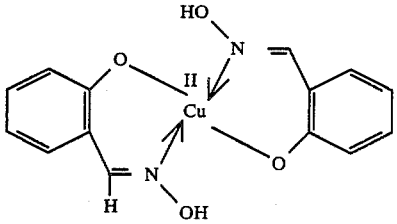
(I)-(47)
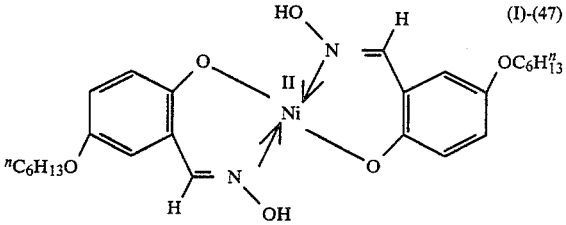
(I)-(48)
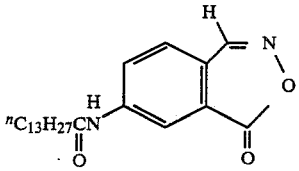
(I)-(49)
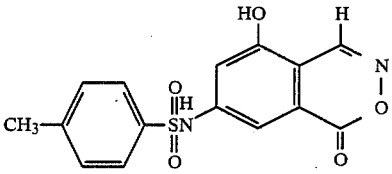
(I)-(50)
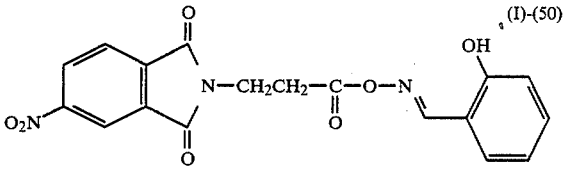
Specific examples of precursor compounds capable of releasing a photographically useful agent which can be used in the present invention are set forth below, but the present invention should not be construed as being limited thereto.

(II)-(1)
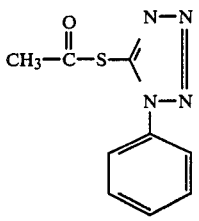
(II)-(2)
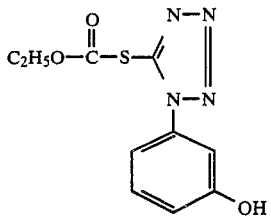
(II)-(3)
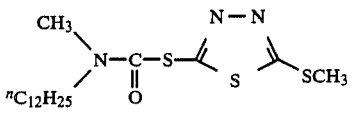
(II)-(4)
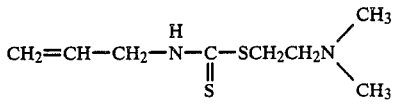
(II)-(5)
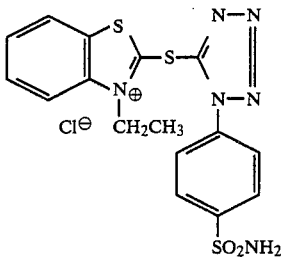
(II)-(6)
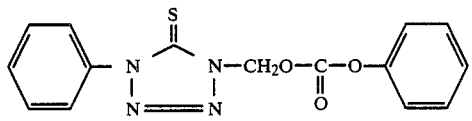
(II)-(7)
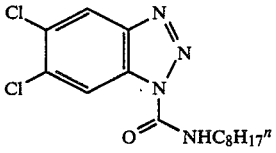
(II)-(8)
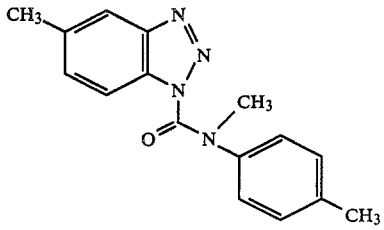
(II)-(9)
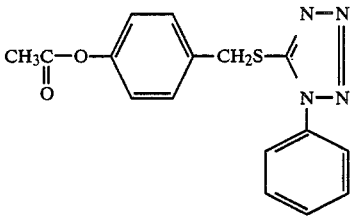
(II)-(10)
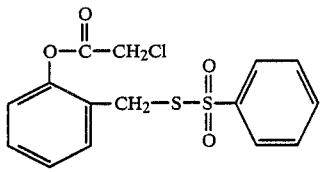
(II)-(11)
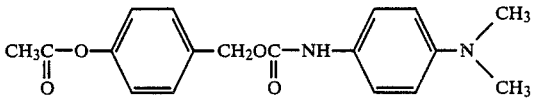
(II)-(12)
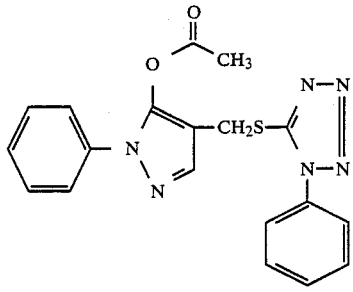
(II)-(13)
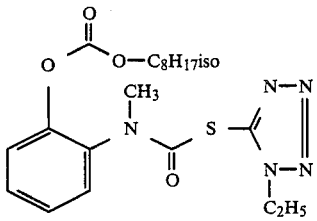
(II)-(14)
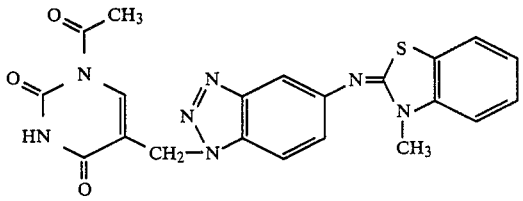

-continued
(II)-(15)
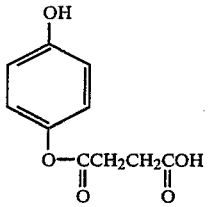
(II)-(16)
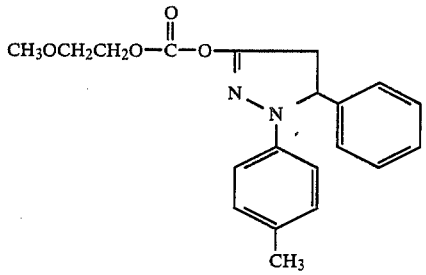
(II)-(17)
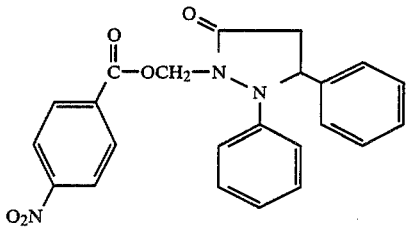
(II)-(18)
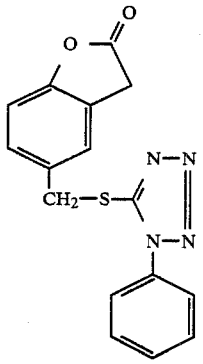
(II)-(19)
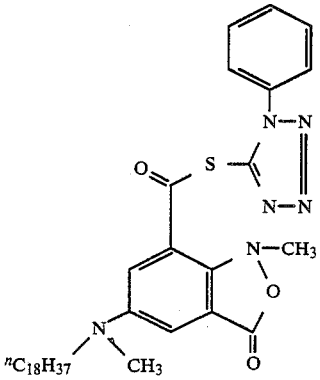
(II)-(20)
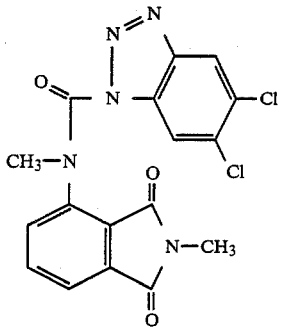
(II)-(21)
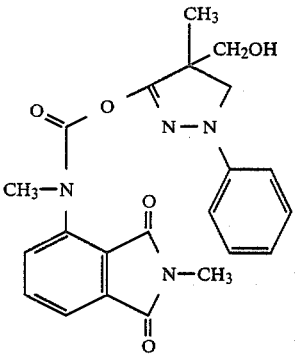
(II)-(22)
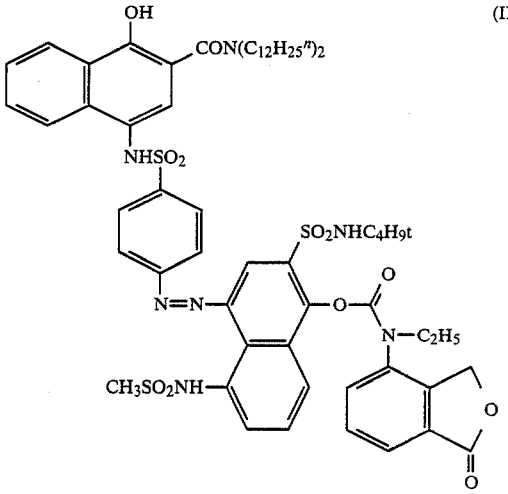

-continued
(II)-(23)
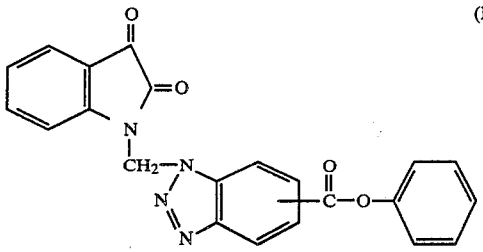
(II)-(24)
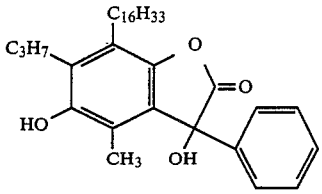
(II)-(25)
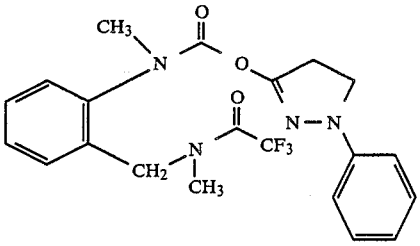
(II)-(26)
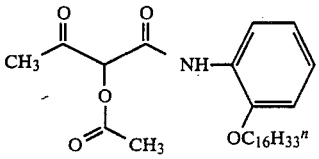
(II)-(27)
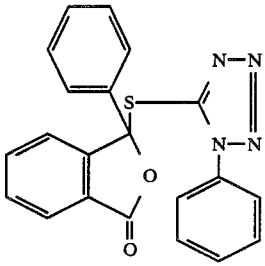
(II)-(28)
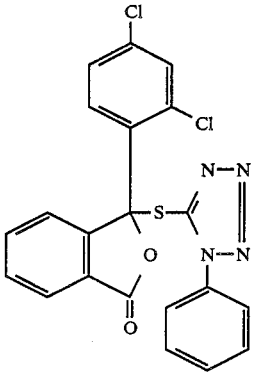
(II)-(29)
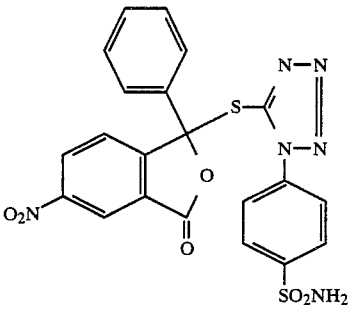
(II)-(30)
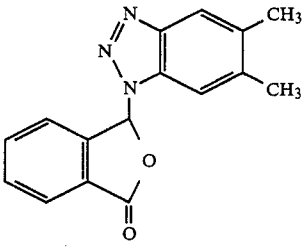
(II)-(31)
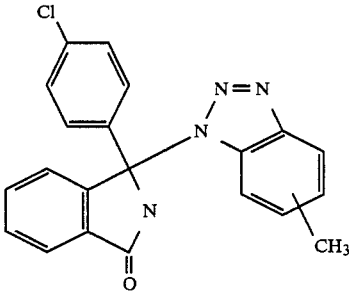
(II)-(32)
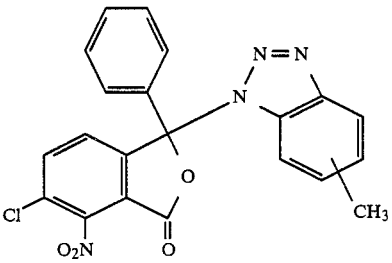

-continued
(II)-(33)
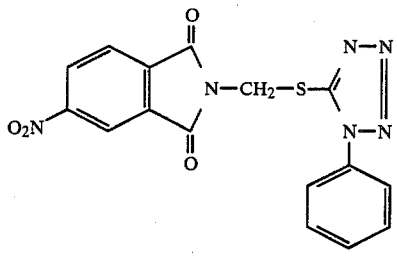
(II)-(34)
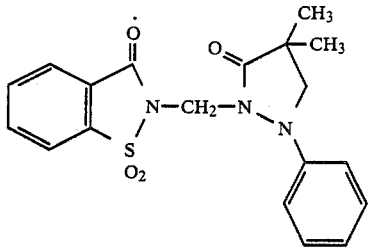
(II)-(35)
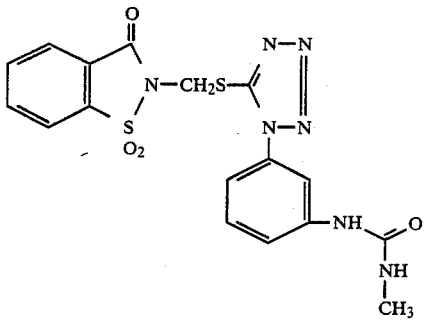
(II)-(36)
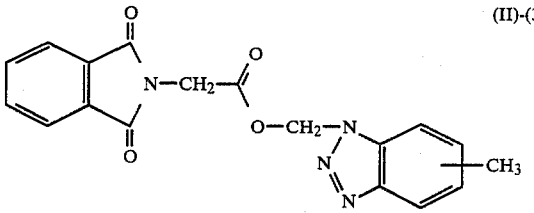
(II)-(37)
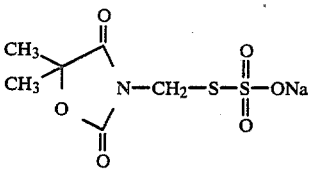
(II)-(38)
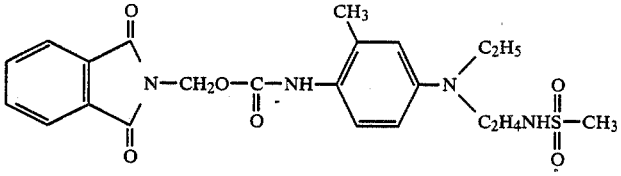
(II)-(39)
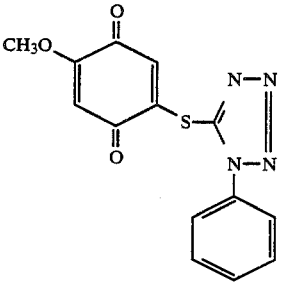
(II)-(40)
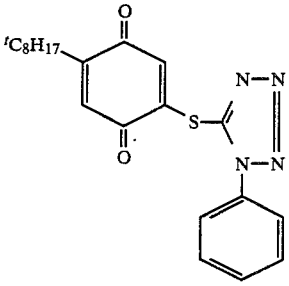
(II)-(41)
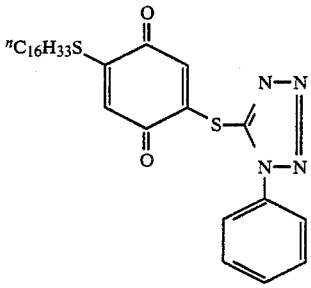
(II)-(42)
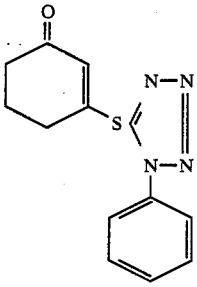
(II)-(43)
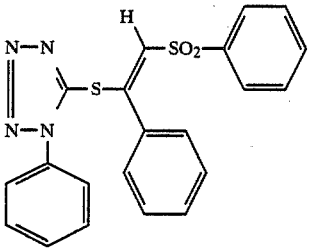
(II)-(44)
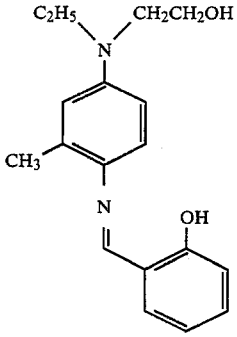

-continued
(II)-(45)
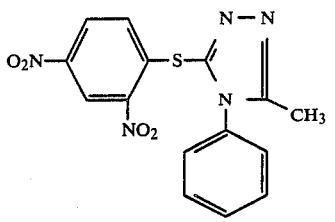
(II)-(46)
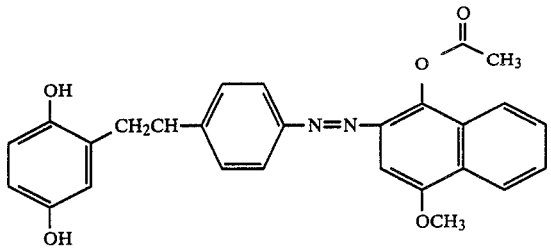
(II)-(47)
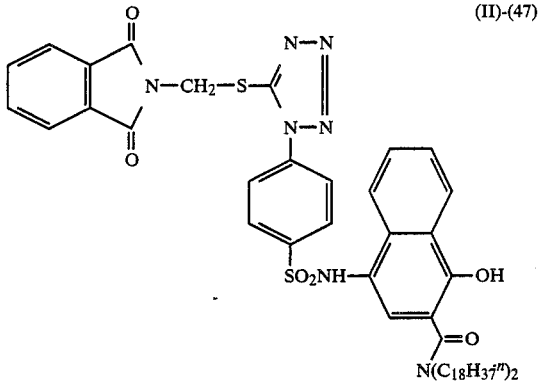
(II)-(48)
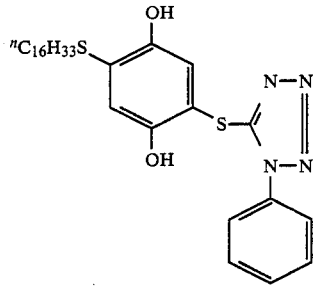
(II)-(49)
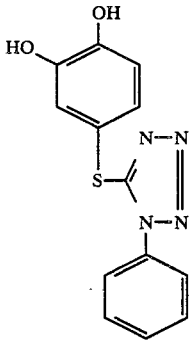
(II)-(50)
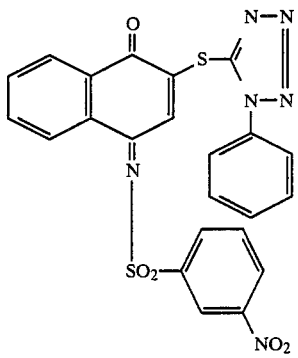
(II)-(51)
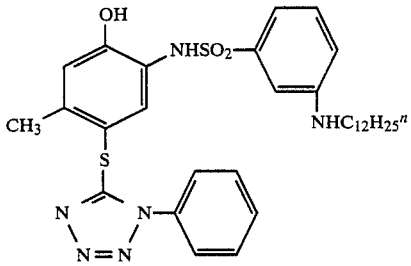
(II)-(52)
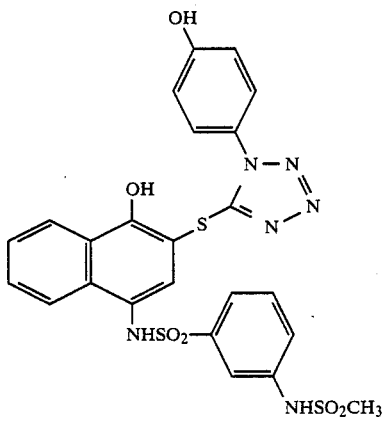

-continued
(II)-(53)
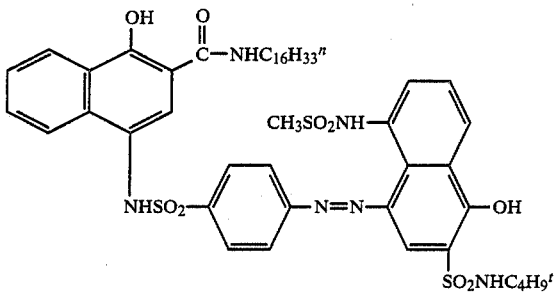
(II)-(54)
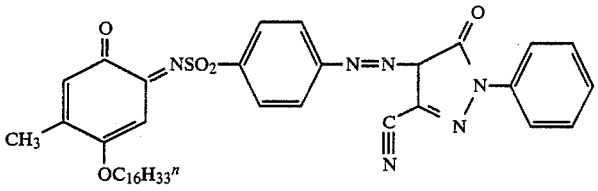
(II)-(55)
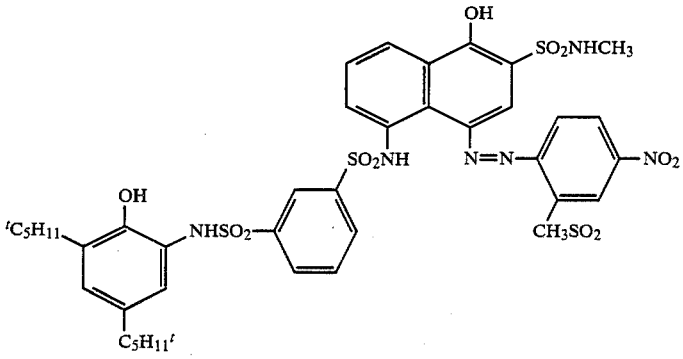
(II)-(56)
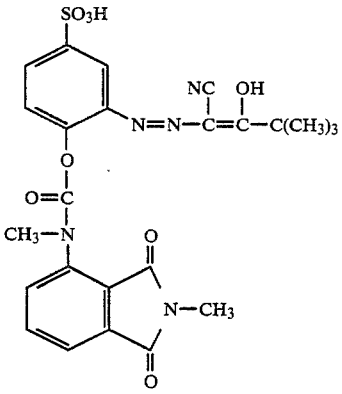

-continued
(II)-(57)
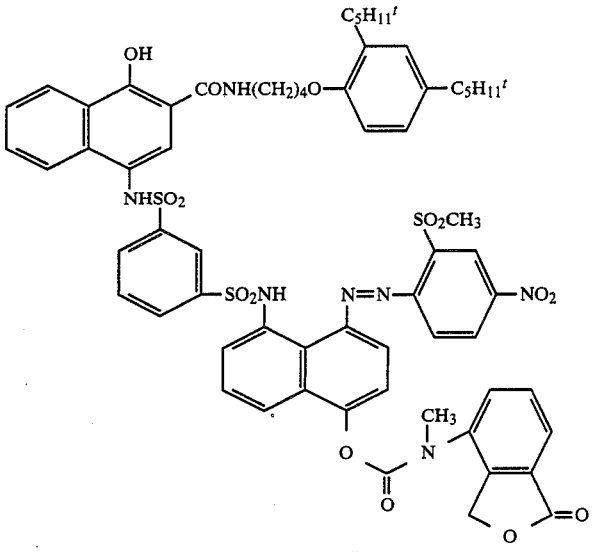
(III)-(1)
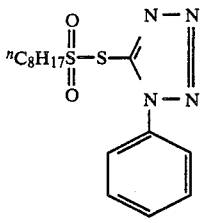
(III)-(2)
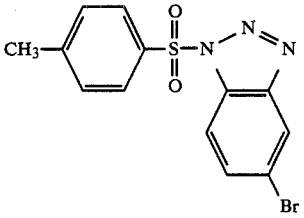
(III)-(3)
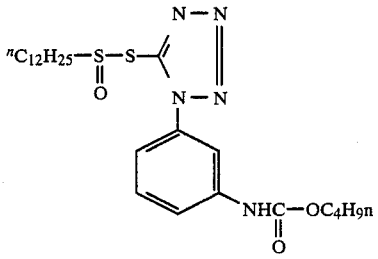
-continued
(III)-(4)
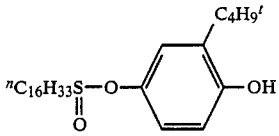
(III)-(5)
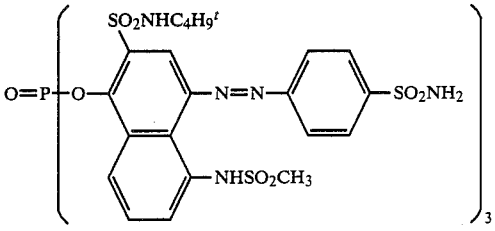
(III)-(6)
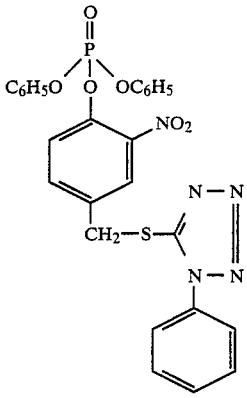
(IV)-(1)
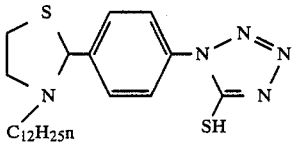
(IV)-(2)
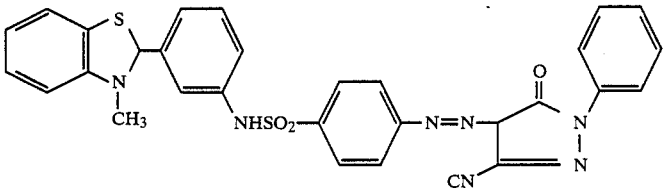

-continued

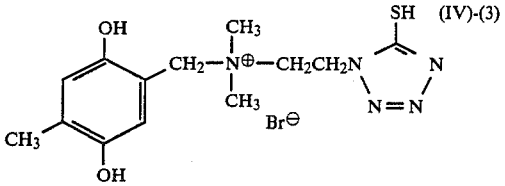

(IV)-(3)

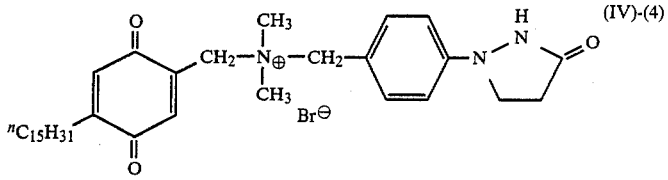

(IV)-(4)

The oximes represented by general formula (I) used in the present invention are known compounds and generally can be easily synthesized by the dehydration condensation reaction of ketones or aldehydes with hydroxylamine. For instance, in Wagner and Zook, *Synthetic Organic Chemistry,* Table 95, page 743 (John Wiley and Sons, Inc. 1953), exmples of oximes, their properties thereof and literature references are specifically described.

The precursor compounds belonging to classes (II) to (IV) can be easily synthesized by known methods as described in the above-cited patent specifications.

The blocked photographic agents belonging to (II) to (IV) capable of releasing a photographically useful agent used in the present invention may be added to any constituent layers of a silver halide photographic light-sensitive material including a silver halide emulsion layer, a coloring material layer, a subbing layer, a protective layer, an interlayer, a filter layer, an antihalation layer, an image-receiving layer, a cover sheet layer and other subsidiary layers.

Incorporation of the precursors used in the present invention into the above-described layers can be carried out by adding them to coating solutions for forming such layers as they are, or dissolved in a proper concentration depending on a physical property of the precursors used in a solvent that will not adversely affect the photographic light-sensitive material, such as water, alcohol or the like. Also, the precursors can first be dissolved in an organic solvent having a high boiling point and/or an organic solvent having a low boiling point, and then emulsified and dispersed in an aqueous solution. Moreover, they may be incorporated into polymer latexes and added in this state, using the methods described in Japanese Patent Application (OPI) Nos. 39853/76, 59942/76 and 32552/79, and U.S. Pat. No. 4,199,363.

The precursors may be added at any stage of production of the photographic light-sensitive material. However, it is generally preferable to add the precursors to the coating solution just before the coating is applied.

The oximes which are employed in the present invention, can be advantageously used either by being added to a processing solution such as a developing solution; or, in the case of precursors having a larger number of carbon atoms, by being incorporated into a photographic light-sensitive material, whereby the precursors and the oximes come into contact with each other as a consequence of diffusion during the processing. In the latter case, it is necessary to prevent the oximes and the precursors from contacting each other during the coating and also prior to processing, preferably by incorporating them into different layers. It is also possible to add them to the photographic light-sensitive material as precursor compounds of oximes in which $R^1$ of the general formula (I) is a group other than a hydrogen atom.

Although the oxime can be added to any layer, it is preferably incorporated in layers such as a subbing layer, a protective layer, an interlayer, a filter layer, an antihalation layer, a coloring material layer, an image-receiving layer, and a cover sheet layer. When the oxime is added to a processing solution, it is preferably used as a developing bath component. However, when the oxime is used in combination with a precursor of a photographically useful agent that is a bleach accelerator or a fix accelerator, it can be advantageously added to a suitable bath subsequent to the development processing.

The present invention can be applied to color photographic light-sensitive materials of the coupler type.

A general method for forming color images using a color photographic light-sensitive material comprises developing a silver halide photographic light-sensitive material with an aromatic primary amine developing agent in the presence of a color coupler which forms a dye by reacting with the oxidation product of the developing agent, to produce an azomethine dye or an indoaniline dye. The basis of the above-described color development method was invented by L. D. Mannes & L. Godowsky in 1935, and today this color development method is universally with various modifications and improvements.

In this method, the subtractive color process is usually employed for color reproduction, using silver halide emulsions selectively sensitized to blue, green and red light along with yellow, magenta and cyan color image forming agents having the respective complementary relations to those colors. In order to form yellow color images, couplers such as acylacetanilide couplars or dibenzoylmethane couplers are used. In order to form magenta color images, pyrazolone couplers, pyrazolobenzimidazole couplers, cyanoacetophenone couplers or indazolone couplers are predominantly used. In order to form cyan color images, phenol couplers e.g., phenols and naphthols, are predominantly used.

In general, color photographic light-sensitive materials are divided broadly into two main groups. One group consists of coupler-in-developer materials which utilize couplers added to a developing solution, and the other group consists of incorporated coupler materials which contain couplers in the color photographic light-sensitive materials. In the latter materials, dye image forming couplers are incorporated in silver halide emulsion layers. For couplers to be added to emulsion layers, it is necessary that they be rendered nondiffusible (diffusion resistant) in the matrix of the emulsion binder.

Color photographic light-sensitive materials having incorporated couplers are basically processed by the following three steps.

(1) Color development step
(2) Bleaching step
(3) Fixing step

The bleaching step and the fixing step may be combined into a bleach-fixing (blixing) step, in which both developed silver and undeveloped silver halide are desilvered. In addition to the above-described basic steps (i.e., the color development step and the desilvering step), development processing typically includes auxiliary steps which enhance the photographic and physical qualities of the image, improve the storability of the image, and so on. For instance, other typical processing steps include a hardening bath for preventing photographic layers from being excessively softened during the processing, a stop bath for stopping a development reaction effectively, an image stabilizing bath for stabilizing images formed, a layer-removing bath for removing a backing layer from the support, and so on.

Couplers are added to or dispersed into gelatin silver halide emulsions or hydrophilic colloidal layers according to conventionally known methods. Specific methods include dispersing a coupler dissolved in an organic solvent having a high boiling point such as dibutyl phthalate, tricresyl phosphate, waxes, a higher fatty acid or its ester, described in U.S. Pat. Nos. 2,304,939 and 2,322,027; a method of dispersing a coupler dissolved in an organic solvent having a low boiling point or a water soluble organic solvent; a method of dispersing a coupler dissolved in a combination of an organic solvent having a high boiling point and an organic solvent having a low boiling point, described in U.S. Pat. Nos. 2,801,170, 2,801,171 and 2,949,360; a method of dispersing a coupler either alone or in combination with other couplers required, such as a colored coupler and an uncolored coupler, where the coupler compound has a low melting point (e.g., not higher than 75° C.), as described in German Pat. No. 1,143,707, and so on can be employed.

Dispersing aids are also generally included with couplers in order to disperse the couplers, including conventionally used surface active agents, for example, anionic surface active agents (e.g., sodium alkylbenzenesulfonates, sodium dioctylsulfosuccinate, sodium dodecylsulfate, sodium alkylnaphthalenesulfonates, Fischer type couplers, etc.), amphoteric surface active agents (e.g., N-tetradecyl-N,N-dipolyethylene-α-betaine, etc.) and nonionic surface active agents (e.g., sorbitan monolaurate, etc.).

the photographic emulsion layer of the photographic light-sensitive material used in the present invention can contain a color forming coupler, i.e., a compound capable of forming a colored compound upon oxidative coupling with an aromatic primary amine developing agent (e.g., phenylenediamine derivatives, aminophenol derivatives, etc.) in color development processing. More specifically, suitable examples of magenta couplers which can be used include 5-pyrazolone couplers, pyrazolobenzimidazole couplers, cyanoacetylcoumarone couplers, and open-chain acylacetonitrile couplers. Suitable examples of yellow couplers which can be used include acylacetamide couplers (e.g., benzoylacetanilides, pivaloylacetanilides, etc.). Suitable examples of cyan couplers which can be used include naphthol couplers, and phenol couplers. Among these couplers, those which contain a hydrophobic group referred to as a ballast group and are thus rendered nondiffusible in the emulsion are preferably employed. These couplers may be either four-equivalent or two-equivalent per silver ion. Further, colored couplers having a color correction effect, or couplers capable of releasing a development inhibitor with increasing development ("DIR couplers") can be employed. Furthermore, non-color forming DIR coupling compounds, which provide colorless products upon the coupling reaction and release development inhibitors, can be employed other than the DIR couplers as described above.

When used in the color diffusion transfer photographic process, the photographic material according to the present invention may constitute any type of film unit, including the peel-apart type, or the integrated type as described in Japanese Patent Publication Nos. 16356/71 and 33697/73, Japanese Patent Application (OPI) No. 13040/75 and British Pat. No. 1,330,524.

Moreover, the compounds according to the present invention can be employed in black-and-white photographic light-sensitive materials. Suitable examples of such black-and-white photographic materials include medical X-ray films for direct photography, black-and-white films for general photography, lithographic films, scanner films and so on.

In the silver halide photographic light-sensitive material according to the present invention, other factors are not critical such as the method of preparation of silver halide emulsions, halogen composition, crystal habit, grain size, chemical sensitizers, antifoggants, stabilizers, surfactants, gelatin hardeners, hydrophilic colloid binders, matting agents, dyes, sensitizing dyes, fading preventing agents, color mixing preventing agents, polymer latexes, brighteners, antistatic agents, and the like. Typical examples of the above components, methods and dimensions which can be used in the light-sensitive material according to the invention are disclosed in *Research Disclosure,* Vol. 176, pages 22 to 31 (December, 1978).

There are no particular restrictions with respect to exposure and development of the silver halide photographic light-sensitive materials according to the present invention, and known methods and processing solutions, for example, those described in *Research Disclosure,* Vol. 176, pages 28 to 30 (December 1978), can be used. The photographic processing may form either silver images (black-and-white photographic processing) or dye images (color photographic processing) as desired. The processing temperature is typically in the range of 18° C. to 50° C., although temperatures lower than 18° C. or those higher than 50° C. may be employed.

Developing solutions to be employed for black-and-white photographic processing can contain known developing agents, such as dihydroxybenzenes (e.g., hydroquinone), 3-pyrazolidones (e.g., 1-phenyl-3-pyrazolidone), and aminophenols (e.g., N-methyl-p-aminophenol). These developing agents may be employed singly or in combination. In addition to the developing agent, developing solutions generally contain other conventional components, such as a preservative, an alkali agent, a pH buffer and an antifoggant and optionally, a dissolution aid, a color toning agent, a development accelerator, a surfactant, a defoaming agent, a water softener, a hardener, and a viscosity providing agent.

The process according to the present invention, can be applied to "lithographic" development processing. In "lithographic" development, in order to photographically reproduce line images or halftone images by means of dots, dihydroxybenzenes are generally used as a developing agent and the developing step proceeds infectiously so long as the concentration of sulfite ion is maintained at a low level.

A color developing solution is, in general, an alkaline aqueous solution containing a color developing agent.

Suitable examples of color developing agents which can be used include known primary aromatic amine developing agents, such as phenylenediamines (e.g., 4-amino-N,N-diethylaniline,. 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidothylaniline, and 4-amino-3-methyl-N-ethyl-N-β-methoxyethylaniline).

In addition to the above-described compounds, those described in L. F. A. Mason, *Photographic Processing Chemistry,* pages 226 to 229 (Focal Press 1966), U.S. Pat. Nos. 2,193,015 and 2,592,364, and Japanese Patent Application (OPI) No. 64933/73 can be used as color developing agents.

After the color development step, photographic emulsion layers are generally subjected to bleaching. The bleaching may be carried out either in the same step as fixing, or in a separate step. Suitable examples of bleaching agents include compounds of polyvalent metals such as iron (III), cobalt (III), chromium (VI), copper (II), peracids, quinones, and nitroso compounds.

Now the present invention is illustrated in more detail by reference to the following examples, but the present invention should not be construed as being limited thereto. Unless otherwise indicated, all parts, percentages and ratios are by weight.

EXAMPLE 1

Determination of Release Acceleration Obtained Using Salicylaldoxime [(I)-(14)] For Various Presursors In order to determine the base rate of release of a photographically useful agent from its precursor, a precursor compound ($3.6\times10^{-5}$ mol) was dissolved in 4 ml of acetonitrile, and the solution was added at 25° C. to a mixed solution of 16 ml of acetonitrile and 20 ml of a Britton-Robinson buffer which had been adjusted to pH 10.0 in advance. After a lapse of a predetermined period of time, a given amount of reaction solution was adjusted to pH 6.25 with acetic acid to stop the reaction. The concentration of photographically useful agent released was quantitatively determined by high performance liquid chromatography.

Based on the obtained value, a pseudo first-order reaction rate constant k' was determined, and then a half-life period $t_{\frac{1}{2}}$ was calculated. The half-life period $t_{\frac{1}{2}}$ indicates the time required for one-half of the precursor compound to react and is calculated by the equation: $t_{\frac{1}{2}}=0.693/k'$.

In order to determine the accelerated rate of release according to the present invention, the half-life period $t_{\frac{1}{2}}$ was calculated in the same manner as above except that $3.6\times10^{-4}$ mol of salicylaldoxime [(I)-(14)] was added to the 16 ml of acetonitrile used above. By comparing the half like period obtained using the oxime with the case in which the compound was not added, the acceleration effect of compound (I)-(14) was determined. The results are shown in Table 1 below.

TABLE 1

Release Acceleration Effect of Compound (I)-(14) (pH = 10.0, 25° C., acetonitrile/buffer = 1/1)

| Precursor Compound No. | $t_{\frac{1}{2}}$ (sec) Compound (I)-(14) Not Added | Added | Acceleration Effect (times) |
|---|---|---|---|
| (II)-(8) | 8,200 | 78 | 105 |
| (II)-(18) | 3,600 | 5.7 | 630 |
| (II)-(27) | 140,000 | 250 | 560 |
| (II)-(29) | 9,000 | 2.8 | 3,200 |
| (II)-(33) | 320 | 1.7 | 190 |
| (II)-(35) | 4,100 | 2.6 | 1,500 |
| (II)-(36) | 1,900 | 5.4 | 350 |
| (II)-(41) | 1,800 | 0.9* | 2,000 |
| (II)-(42) | $4.3\times10^{7}$** | 4,400 | 9,800 |
| (II)-(50) | 7,000 | 3.5 | 2,000 |

Note:
*Value as determined by extrapolating the values measured at pH = 8.0, 8.5 and 9.0.
**Value as determined by extrapolating the values measured at pH = 13.0, 12.5 and 12.0.

It can be seen from the results shown in Table 1 that salicylaldoxime (I)-(14) greatly accelerates the release of each photographically useful agent from its precursor compound.

EXAMPLE 2

Determination of Release Acceleration Using Various Oximes

By the same procedure as described in Example 1, the release acceleration effect of various oximes was measured for three different precursor compounds. This effect was also measured for comparative compounds. The results are shown in Table 2.

TABLE 2

Acceleration Effect of Various Oximes (pH = 10.0, 25° C., acetonitrile/buffer = 1/1)

| Oxime | Precursor Compound (II)-(18) $t_{\frac{1}{2}}$ (sec) | Acceleration Effect (times) | (II)-(29) $t_{\frac{1}{2}}$ (sec) | Acceleration Effect (times) | (II)-(36) $t_{\frac{1}{2}}$ (sec) | Acceleration Effect (times) |
|---|---|---|---|---|---|---|
| not added | 3,600 | — | 9,000 | — | 1.900 | — |
| (I)-(6) | 30 | 120 | 14 | 640 | 26 | 72 |
| (I)-(11) | 120 | 30 | 39 | 230 | 158 | 12 |
| (I)-(14) | 5.7 | 630 | 2.6 | 3,500 | 5.4 | 350 |
| (I)-(31) | 7.3 | 490 | 3.8 | 2,400 | 7.9 | 240 |
| (I)-(34) | 6.2 | 580 | 4.3 | 2,100 | 6.1 | 310 |
| Comparative Compound A | 3,500 | 1.0 | 9,100 | 0.99 | 1,800 | 1.1 |
| Comparative | 3,300 | 1.1 | 6,900 | 1.3 | 1,600 | 1.2 |

TABLE 2-continued

Acceleration Effect of Various Oximes
(pH = 10.0, 25° C., acetonitrile/buffer = 1/1)

| Oxime | Precursor Compound (II)-(18) $t_{\frac{1}{2}}$ (sec) | Acceleration Effect (times) | (II)-(29) $t_{\frac{1}{2}}$ (sec) | Acceleration Effect (times) | (II)-(36) $t_{\frac{1}{2}}$ (sec) | Acceleration Effect (times) |
|---|---|---|---|---|---|---|
| Compound B | | | | | | |

Comparative Compound A

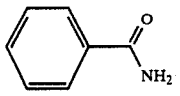

Comparative Compound B

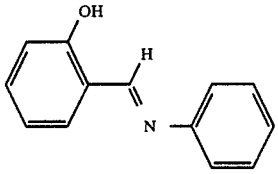

As shown in Table 2 above, a great acceleration effect could be obtained using each oxime according to the present invention, whereas little or no acceleration effect could be obtained using Comparative Compounds A and B.

EXAMPLE 3

A subbing layer, an emulsion layer and a protective layer as described hereinafter were coated on a cellulose triacetate film to prepare Samples 1 to 5.

The emulsified dispersion was prepared by dissolving an antifoggant precursor (DIR compound) as shown in Table 3 below and Magenta Coupler (C-1) in a mixed solvent of tricresyl phosphate and ethyl acetate and then emulsifying and dispersing the resulting solution in an aqueous gelatin solution.

(1) Emulsion Layer

| | |
|---|---|
| Negative Type Silver Iodobromide Emulsion (grain size: 1.5μ) | $1.6 \times 10^{-2}$ mol/m$^2$ (calculated as silver) |
| Antifoggant Precursor (DIR Compound) | $8.0 \times 10^{-5}$ mol/m$^2$ |
| Magenta Coupler (C-1) | $1.33 \times 10^{-3}$ mol/m$^2$ |
| Tricresyl Phosphate | 0.95 g/m$^2$ |
| Gelatin | 2.5 g/m$^2$ |

(2) Protective Layer

| | |
|---|---|
| 2,4-Dichloro-6-hydroxy-s-triazine Sodium Salt | 0.05 g/m$^2$ |
| Gelatin | 1.30 g/m$^2$ |

Each sample was allowed to stand for 14 hours at 40° C. and 70% relative humidity, was then exposed to white light for sensitometry, and then subjected to color development processing described below (Processing A). The green density of the thus-processed sample was measured to obtain the data in Table 3.

Color Development Processing

| Step | Time | Temperature (°C.) |
|---|---|---|
| 1. Color Development | 3 min 15 sec | 38 |
| 2. Bleaching | 6 min 30 sec | " |
| 3. Water Washing | 2 min | " |

-continued

| Step | Time | Temperature (°C.) |
|---|---|---|
| 4. Fixing | 4 min | " |
| 5. Water Washing | 4 min | " |
| 6. Stabilization | 1 min | " |

The composition of the processing solution used in each step was as follows:

Color Developing Solution

| | |
|---|---|
| Water | 800 ml |
| 4-(N—Ethyl-N—Hydroxyethyl)amino-2-Methylaniline Sulfate | 5 g |
| Sodium Sulfite | 5 g |
| Potassium Carbonate | 30 g |
| Potassium Hydrogencarbonate | 1.2 g |
| Potassium Bromide | 1.2 g |
| Sodium Chloride | 0.2 g |
| Trisodium Nitrilotriacetate | 1.2 g |
| Water to make | 1000 ml (pH: 10.1) |

Bleaching Solution

| | |
|---|---|
| Water | 800 ml |
| Iron (III) Ammonium Ethylenediamine-tetraacetate | 100 g |
| Disodium Ethylenediaminetetraacetate | 10 g |
| Potassium Bromide | 150 g |
| Acetic Acid | 10 g |
| Water to make | 1000 ml (pH: 6.0) |

Fixing Solution

| | |
|---|---|
| Water | 800 ml |
| Ammonium Thiosulfate | 150 g |
| Sodium Sulfite | 10 g |
| Sodium Hydrogensulfite | 2.5 g |
| Water to make | 1000 ml (pH: 6.0) |

Stabilizing Solution

| | |
|---|---|
| Water | 800 ml |
| Formalin (37%) | 5 ml |
| Driwel (Trademark; surface active agent) | 3 ml |
| Water to make | 1000 ml |

The same processing as Processing A was repeated with the exception that $9\times10^{-3}$ mol of each of the oximes shown in Table 3 below was added to 1 liter of the color developing solution used in Processing A. These are referred to as Processing Solutions B to D. The maximum color densities of Samples 1 to 5 when processed using Processing Solutions A to D are shown in Table 3 below.

TABLE 3

| Sample No. | Antifoggant Precursor (DIR Compound) | Processing Solution A | B (I)-(14) | C (I)-(31) | D (I)-(34) |
|---|---|---|---|---|---|
| 1 | not added (control) | 1.42 | 1.39 | 1.40 | 1.42 |
| 2 | (II)-(18) | 1:39 | 0.69 | 0.75 | 0.82 |
| 3 | (II)-(29) | 1.40 | 0.95 | 1.09 | 1.10 |
| 4 | (II)-(36) | 1.41 | 0.86 | 0.92 | 0.89 |
| 5 | (II)-(48) | 1.40 | 0.82 | 0.84 | 0.86 |

It can be seen from the results shown in Table 3 that when Processing Solution A with no oxime is used, the reduction in color density is small for Samples 2 to 5 containing the antifoggant precursor compound (DIR compound), whereas when each of Processing Solutions B to D containing the oximes according to the invention is used, a large reduction in color density is observed for all Samples 2 to 5 containing the antifoggant precursor compound (DIR compound).

This demonstrates that the oximes used according to the invention accelerate the release of the antifoggant from the precursor compound in Samples 2 to 4 and the release of the antifoggant from the cross oxidized product of the DIR compound in Sample 5.

Coupler (C-1) as used herein has the following formula:

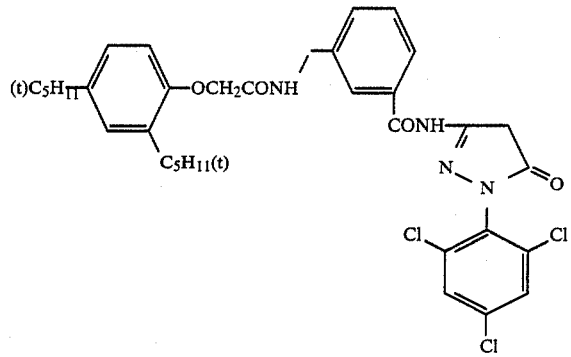

EXAMPLE 4

Samples 6 to 9 were prepared in the same manner as described in Example 3 except that the emulsion layer further contained an oxime precursor ($8\times10^{-4}$ mol/m$^2$). These film samples were each exposed to light in the same manner as described in Example 3 and processed by Processing A and B of Example 3. The resulting photographic properties are shown in Table 4 below.

TABLE 4

| Sample No. | Antifoggant Precursor | Processing A: Oxime Precursor | Fog | Relative Sensitivity | Processing B: Fog | Relative Sensitivity |
|---|---|---|---|---|---|---|
| 1 of Example 3 (control) | (not added) | (not added) | 0.14 | 100 | 0.13 | 95 |
| 3 of Example 3 (comparison) | (II)-(29) | (not added) | 0.14 | 100 | 0.08 | 94 |
| 6 | (II)-(29) | (I)-(40) | 0.10 | 99 | 0.07 | 93 |
| 7 | (II)-(29) | (I)-(41) | 0.09 | 98 | 0.08 | 94 |
| 4 of Example 3 (comparison) | (II)-(36) | (not added) | 0.13 | 99 | 0.06 | 93 |
| 8 | (II)-(36) | (I)-(43) | 0.08 | 95 | 0.05 | 93 |
| 9 | (II)-(36) | (I)-(44) | 0.09 | 97 | 0.08 | 94 |

It can be seen from the results shown in Table 4 that in the processing of samples 1, 3 and 4 without oxime precursor by Processing Solution A also without oxime, fog is not reduced, although in these samples fog is reduced with almost no decrease of relative sensitivity when using Processing Solution B with oxime. It is also apparent that in Samples 6 to 9 having oxime precursors incorporated into the light-sensitive material, fog is considerably reduced while maintaining relative sensitivity substantially at the original level when using Processing Solution A. This clearly demonstrates the acceleration effect of the oxime according to the invention in releasing the antifoggant in both cases whether the oxime is added to a processing solution, or incorporated into a light-sensitive material.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic light-sensitive material after image-wise exposure to radiation comprising a support having thereon a light-sensitive silver halide emulsion layer having associated therewith a blocked photographic agent capable of releasing a photographically useful agent, which method comprises processing the photographic light-sensitive material in the presence of a non-polymeric oxime represented by the following formula (I) which has 1 to 10 carbon atoms:

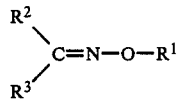

(I)

wherein $R^1$ represents a hydrogen atom; $R^2$ represents a hydrogen atom, a substituted or unsubstituted methyl group or a substituted or unsubstituted ethyl group; and $R^3$ represents a phenyl group having at least one ortho-hydroxy group and may be further substituted, a substituted or unsubstituted hydroxylimino group, a substituted or unsubstituted pyridyl group or a substituted or unsubstituted purinyl group or $R^2$ and $R^3$ form a ring selected from cyclopentane, cyclohexane, cyclohexadiene, cycloheptane, cycloheptadiene, indane or fluorene, and each of the these rings may be substituted, wherein the compound of general formula (I) is added to a developing solution and wherein the blocked photographic agent releases a mercapto or an azole antifoggant, said blocked agent being present in the photographic light-sensitive material in an amount of from about $10^{-9}$ to $10^{-1}$ mol per mol of silver.

2. A method for processing a silver halide photographic light-sensitive material as claimed in claim 1, wherein $R^2$ and $R^3$ are substituted with a halogen atom, a hydroxy group, an alkoxy group, an alkyl group, an aryl group, a nitro group, a carboxy group, a carbonamido group, a sulfonamido group or a methylol group.

3. A method for processing a silver halide photographic light-sensitive material as claimed in claim 1, wherein the blocked photographic agent is a precursor compound capable of releasing a photographically useful agent by hydrolysis in contact with alkali.

4. A method for processing a silver halide photographic light-sensitive material as claimed in claim 3, wherein the blocked photographic agent is a redox compound which releases a photographically useful agent by hydrolysis after the oxidation-reduction reaction during development.

5. A method for processing a silver halide photographic light-sensitive material as claimed in claim 3, wherein the blocked photographic agent is a precursor compound which releases a photographically useful agent by the nucleophilic attack of $OH^-$ ion and the subsequent reaction.

6. A method for processing a silver halide photographic light-sensitive material as claimed in claim 5, wherein the precursor compound comprises at least one of a

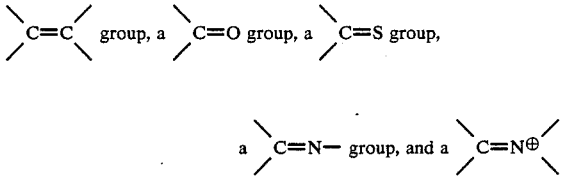

group.

7. A method for processing a silver halide photographic light-sensitive material as claimed in claim 5, wherein the precursor compound comprises at least one of a

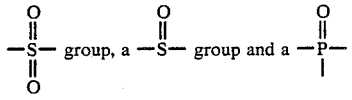

group.

8. A method for processing a silver halide photographic light-sensitive material as claimed in claim 5, wherein the precursor compound comprises a

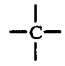

group forming said photographically useful agent, by cleavage at this group.

9. A method for processing a silver halide photographic light-sensitive material as claimed in claim 5, wherein the precursor compound comprises at least one of a

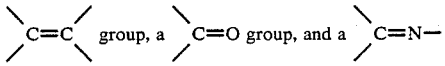

group.

10. A method for processing a silver halide photographic light-sensitive material as claimed in claim 1, wherein the blocked photographic agent releases the mercapto antifoggant.

11. A method for processing a silver halide photographic light-sensitive material as claimed in claim 1, wherein the blocked photographic agent releases the azole antifoggant, said agent being present in the photographic light-sensitive material in an amount of from about $10^{-8}$ to $10^{-1}$ mol per mol of silver.

12. A method for processing a silver halide photographic light-sensitive material as claimed in claim 1, wherein the compound represented by the general formula (I) is added to the developing solution in an amount of from about $10^{-3}$ to 1 mol per liter of the processing solution.

13. A method for processing a silver halide photographic light-sensitive material as claimed in claim 1, wherein the blocked photographic agent is present in a silver halide emulsion layer, a coloring material layer, a subbing layer, a protective layer, an interlayer, a filter layer, an antihalation layer, an image-receiving layer or a cover sheet layer.

14. A method for processing a silver halide photographic light-sensitive material as claimed in claim 1, wherein the photographic light-sensitive material further contains a color coupler.

15. A method for processing a silver halide photographic light-sensitive material as claimed in claim 1, wherein the oxime increases the releasing efficiency of photographically useful agent while retarding side reactions.

16. A method for processing a silver halide photographic light-sensitive material as claimed in claim 10, wherein the mercapto antifoggant is present in the photographic light-sensitive material in an amount of from about $10^{-6}$ to $10^{-2}$ mol per mol of silver.

17. A method for processing a silver halide photographic light-sensitive material as claimed in claim 1, wherein the azole antifoggant is present in the photographic light-sensitive material in an amount of from about $10^{-5}$ to $10^{-2}$ mol per mol of silver.

* * * * *